US009909590B1

(12) United States Patent
Nicholas et al.

(10) Patent No.: US 9,909,590 B1
(45) Date of Patent: Mar. 6, 2018

(54) COMPACT CEILING FANS

(71) Applicant: The L.D. Kichler Co., Cleveland, OH (US)

(72) Inventors: Kenneth J. Nicholas, Parma, OH (US); Wendy Ann Birchfield, Parma Heights, OH (US); David H. Porter, Monticello, WI (US)

(73) Assignee: The L.D. Kichler Co., Cleveland, OH (US)

( * ) Notice: Subject to any disclaimer, the term of this patent is extended or adjusted under 35 U.S.C. 154(b) by 721 days.

(21) Appl. No.: 14/215,452

(22) Filed: Mar. 17, 2014

Related U.S. Application Data

(60) Provisional application No. 61/788,415, filed on Mar. 15, 2013.

(51) Int. Cl.
*F04D 19/00* (2006.01)

(52) U.S. Cl.
CPC ..... *F04D 19/002* (2013.01)

(58) Field of Classification Search
CPC ..... F04D 19/002
USPC ..... 416/244 R, 5, 214 R, 206, 207, 210 R, 416/204 R; D23/11, 377, 379, 385, 411, D23/413
See application file for complete search history.

(56) References Cited

U.S. PATENT DOCUMENTS 1,462,424 A * 7/1923 Sametz ..... B63H 1/20 416/210 R
1,729,277 A * 9/1929 Rodgers ..... F04D 25/08 416/238
1,868,113 A * 7/1932 Ljungstrom ..... F04D 29/382 415/119
2,102,913 A * 12/1937 Preston ..... F04D 29/382 416/214 R
2,208,084 A * 7/1940 Elmer ..... F04D 29/382 416/131
2,286,670 A * 6/1942 Condon ..... F04D 29/382 415/227
5,951,253 A * 9/1999 Gajewski ..... F04D 25/088 416/205
D493,879 S * 8/2004 Young ..... D23/377
6,769,883 B2 * 8/2004 Brid ..... F04D 25/082 310/63
6,948,910 B2 * 9/2005 Polacsek ..... F03D 1/0608 416/1
7,309,213 B2 * 12/2007 Steinke ..... B63H 1/265 415/908
D596,285 S * 7/2009 Liu ..... D23/413
8,133,028 B2 * 3/2012 Liu ..... F03D 3/062 416/204 R
D670,802 S * 11/2012 Wang ..... D23/413
2007/0104583 A1 * 5/2007 Gajewski ..... F04D 25/088 416/210 R

* cited by examiner

*Primary Examiner* — Jessica Cahill
*Assistant Examiner* — Daphne M Barry
(74) *Attorney, Agent, or Firm* — Calfee, Halter & Griswold, LLP

(57) ABSTRACT

Compact ceiling fans having fan blades with a longitudinal axis extending substantially vertically and ceiling fans having one or more fan blades are extend under the housing of the fan across the span of the fan and are suspended only at the distal ends of radially extending arms.

20 Claims, 36 Drawing Sheets

COMPACT CEILING FANS

CROSS REFERENCE TO RELATED APPLICATIONS

This application claims priority to, and any other benefit of, U.S. Provisional Patent Application Ser. No. 61/788,415, filed on Mar. 15, 2013, and entitled Compact Ceiling Fans, which application is hereby incorporated by reference in its entirety. This application also claims priority to U.S. Design patent application Ser. No. 29/449,928, filed on Mar. 15, 2013, and entitled Ceiling Fans, which application is hereby incorporated by reference in its entirety.

BACKGROUND

Ceiling fans typically have fan blades with a longitudinal axis that extend radially in a horizontal plane.

SUMMARY

In exemplary embodiments, ceiling fans have fan blades with a longitudinal axis extending substantially vertically. This results in fans that are very compact. In other exemplary embodiments, ceiling fans have one or more fan blades are extend under the housing of the fan across the span of the fan and are suspended only at the distal ends of radially extending arms.

One embodiment of the present disclosure relates to a ceiling fan suspended by a down rod held by a hanger bracket including a down rod having a longitudinal axis and comprising at least one member; a motor having a non-moving portion affixed to the down rod, the motor further having a moving portion affixed to a drive shaft extending down from the moving portion of the motor, the drive shaft positioned coaxially with the down rod, and the drive shaft comprising at least one coaxial member; a housing that encloses at least a portion of the motor; and a plurality of blades rotationally driven by the downwardly extending drive shaft, the blades extending outward radially up and around at least a portion of the housing and back inward radially to meet at a central point proximate a portion of the down rod above the motor. (CP138865 and CP138868)

Another embodiment of the present disclosure relates to a ceiling fan suspended by a down rod held by a hanger bracket including a down rod having a longitudinal axis and comprising at least one member; and a motor having a non-moving portion affixed to the down rod, the motor further having a moving portion that rotates a plurality of blades around a drive axis of the motor; a housing that encloses at least a portion of the motor; and wherein the plurality of blades each comprises an upper end, a lower end, a radially inner edge, and a radially outer edge; and wherein the upper end of each of the plurality of fan blades is proximate at least one of the housing and the down rod; and wherein the lower end of each of the plurality of fan blades is proximate at least one of the housing and the down rod; and wherein a majority of the radially inner edge of each of the plurality of fan blades is less than an inch or a half-inch or a quarter-inch from the housing. (CP138865 and CP138869)

Still another embodiment of the present disclosure relates to a ceiling fan suspended by a down rod held by a hanger bracket including a down rod having a longitudinal axis and comprising at least one member; a motor having a non-moving portion affixed to the down rod, the motor further having a moving portion that rotates at least first and second arms around a drive axis of the motor; a housing that encloses at least a portion of the motor, the arms extending radially outward; and a fan blade having first and second ends supported by the first and second arms, respectively, the first end of the fan blade affixed to a distal end of the first arm, and the second end of the fan blade affixed to a distal end of the second arm; and the fan blade extending down from the distal end of the first arm, extending under the housing, and extending back up to the distal end of the second arm, the fan blade being unsupported by the housing and unsupported by the motor. (CP138856)

DETAILED DESCRIPTION

Figure 1:
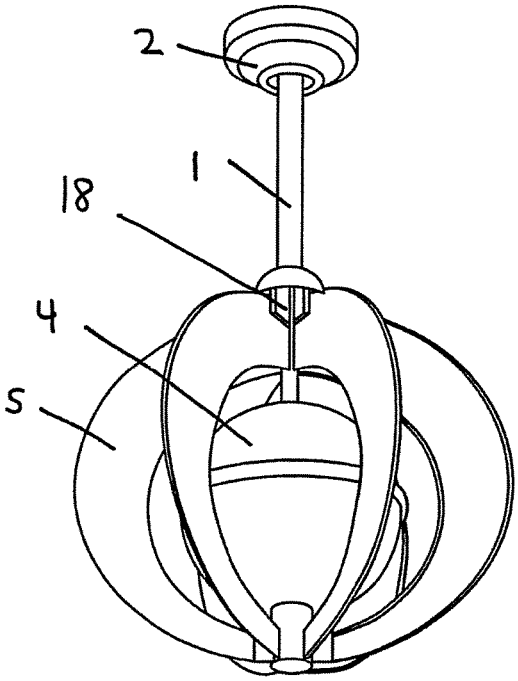
FIG. 1 is a front/bottom view of an exemplary fan with flat blades (CP138868 planar).
Figure 2A:
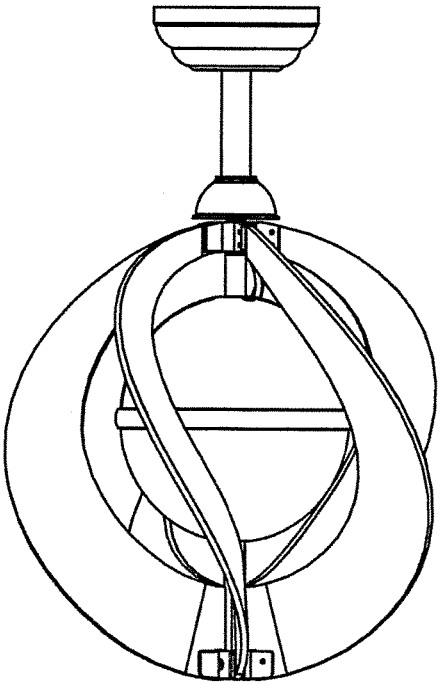
FIGS. 2A-7 are various views of a similar fan with curved blades and views of the blades of this fan (the blades are identical) (CP138868 non-planar).
Figure 2B:
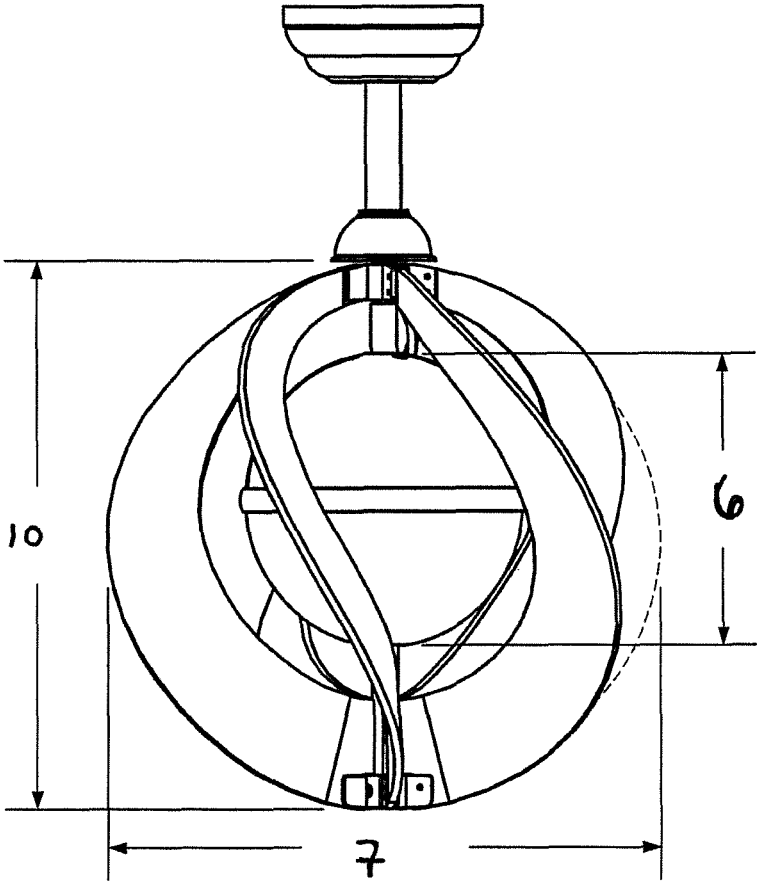
Figure 3A:
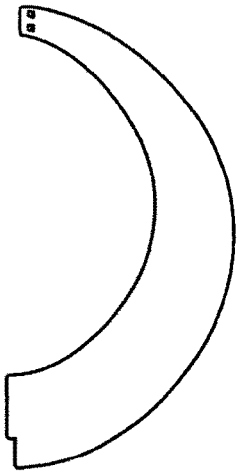
Figure 3B:
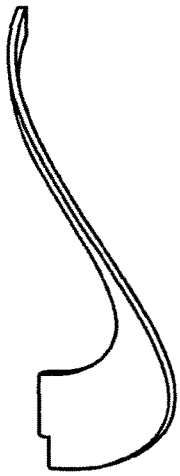
Figure 4:
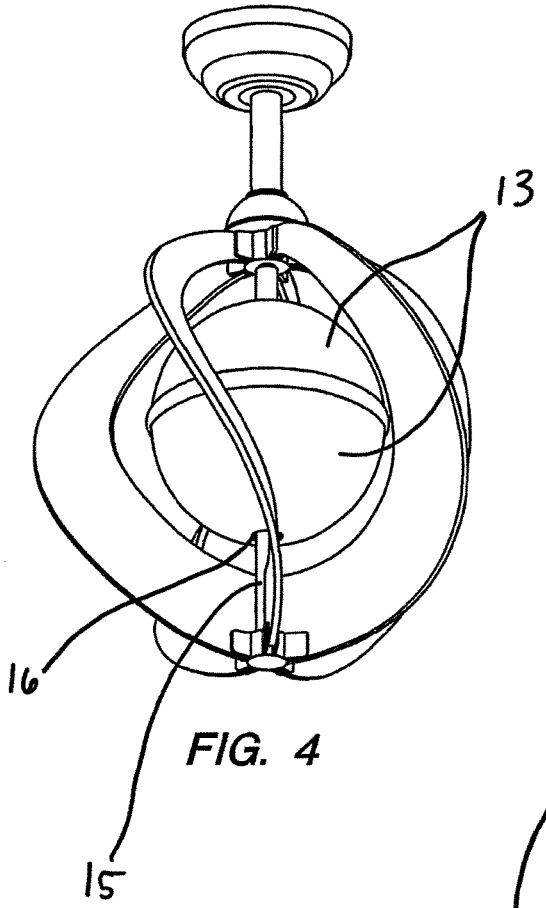
Figure 5:
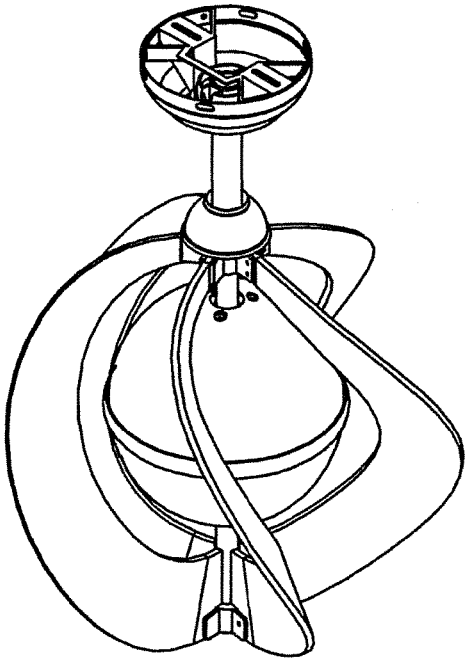
Figure 6:
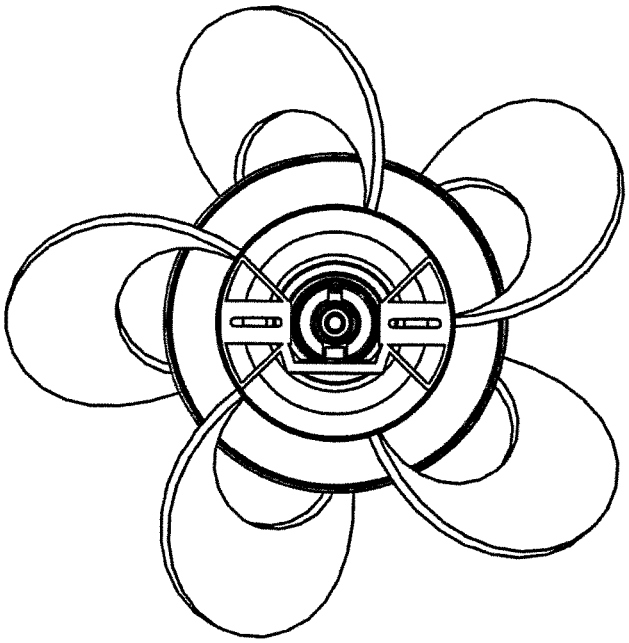
Figure 7:
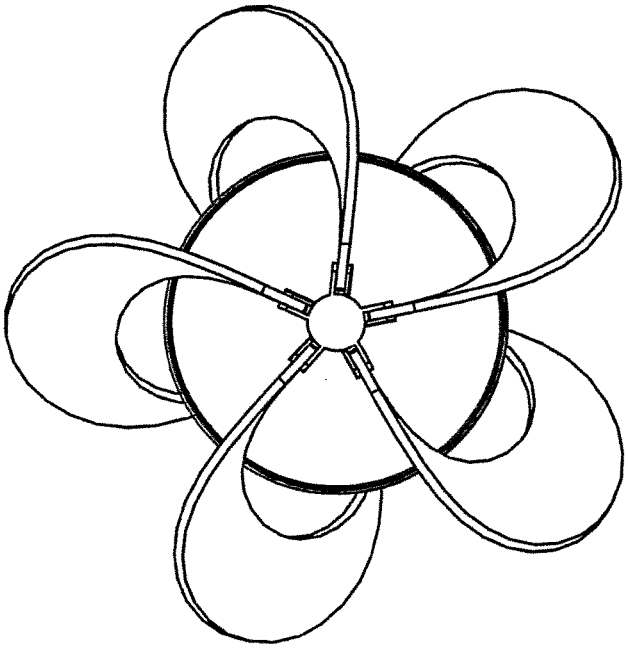

This Detailed Description merely describes exemplary embodiments of the invention and is not intended to limit the scope of the claims in any way. Indeed, the invention as claimed is broader than and unlimited by the preferred embodiments, and the terms used in the claims have their full ordinary meaning.

The present application discloses compact ceiling fans having fan blades with a longitudinal axis extending substantially vertically and ceiling fans having one or more fan blades are extend under the span of the fan and are suspended only at the distal ends of radially extending arms.

Referring now to the Figures, FIGS. 1-8 show various images of two exemplary fans (CP138868). The exemplary fans of FIGS. 1-8 are ceiling fans suspended by a down rod 1 held by a hanger bracket 2 including a down rod having a longitudinal axis and comprising at least one member; a motor 3 having a non-moving portion affixed to the down rod, the motor further having a moving portion 14 affixed to a drive shaft 15 extending down from the moving portion of the motor, the drive shaft positioned coaxially with the down rod, and the drive shaft comprising at least one coaxial member; a housing 4 that encloses at least a portion of the motor; and a plurality of blades 5 rotationally driven by the downwardly extending drive shaft, the blades extending outward radially up and around at least a portion of the housing and back inward radially to meet at a central point 18 proximate a portion of the down rod above the motor.

Figure 8:
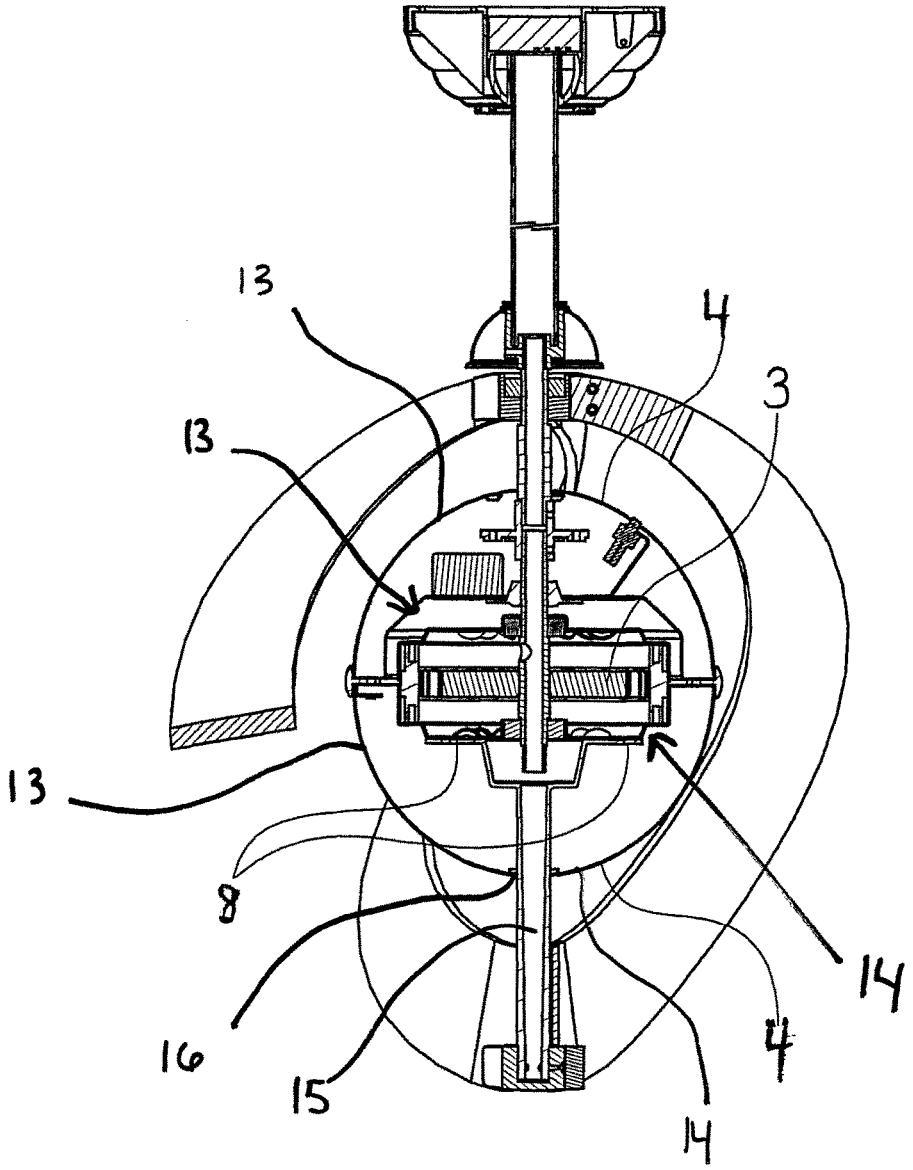
FIG. 8 is a vertical sectional view of the fan of FIGS. 2A-7.
Figure 9:
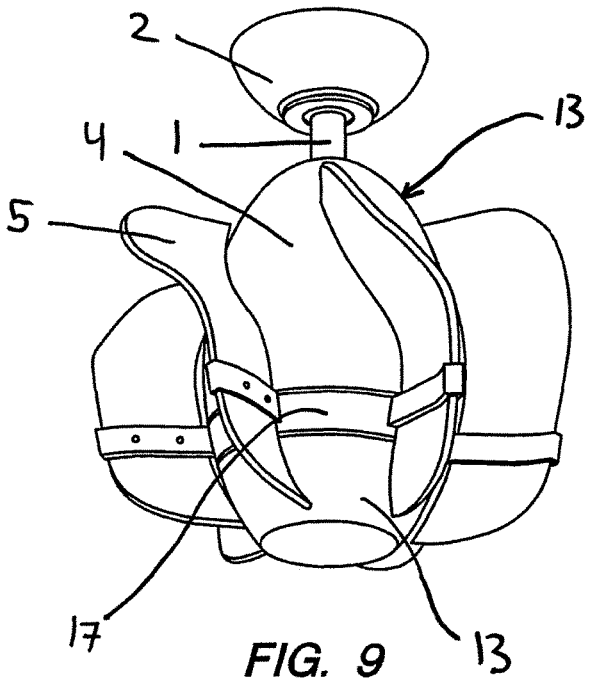
FIG. 9 is a front/bottom view of an exemplary fan (CP138869).
Figure 10:
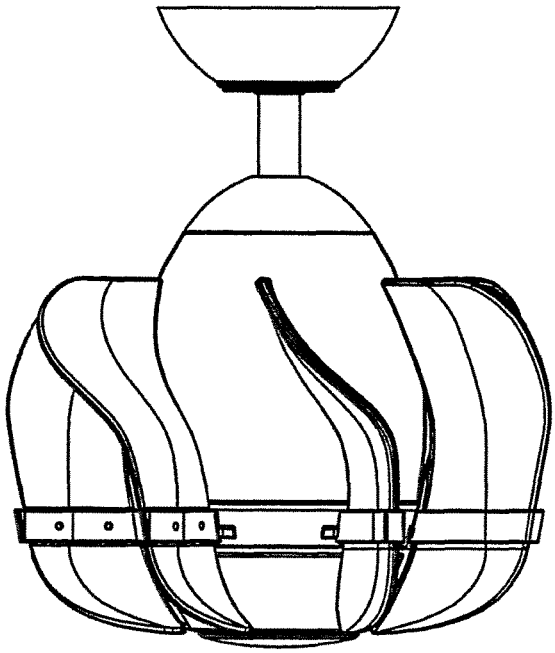
FIGS. 10-19 are various views of a similar fan and views of the blades of this fan (the blades are identical) (CP138869).
Figure 11:
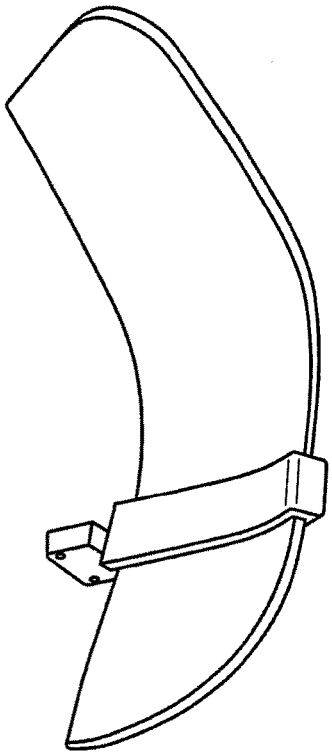
Figure 12:
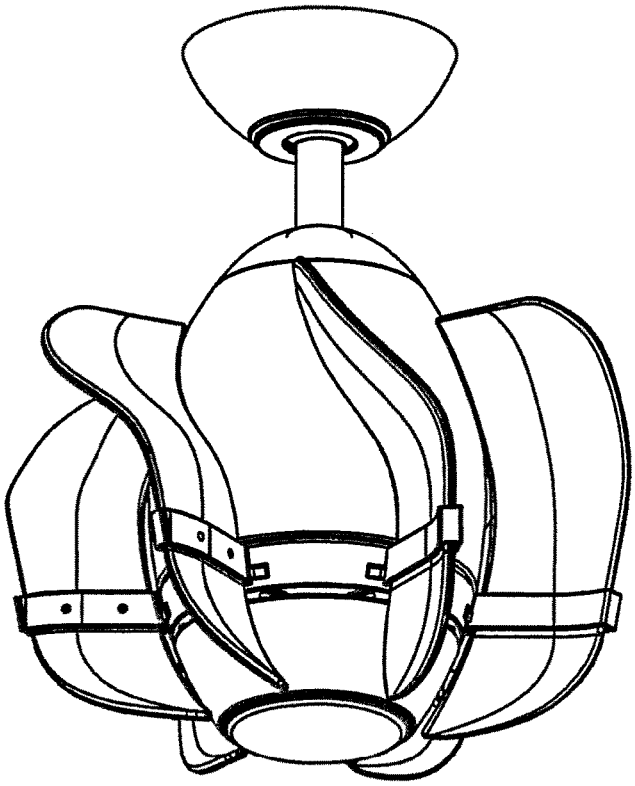
Figure 13:
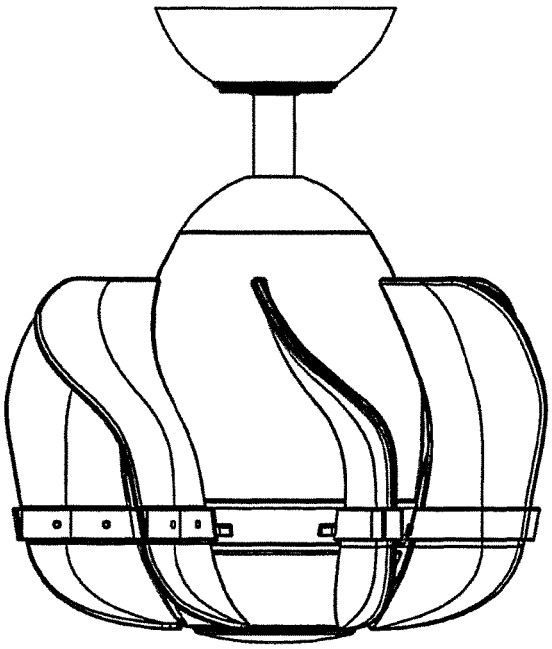
Figure 14:
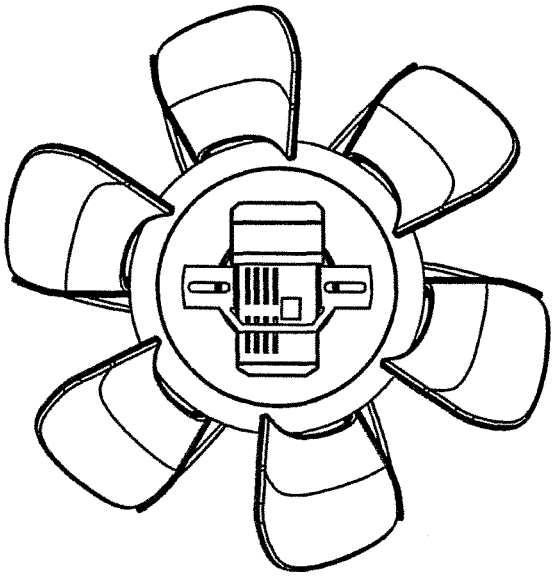
Figure 15:
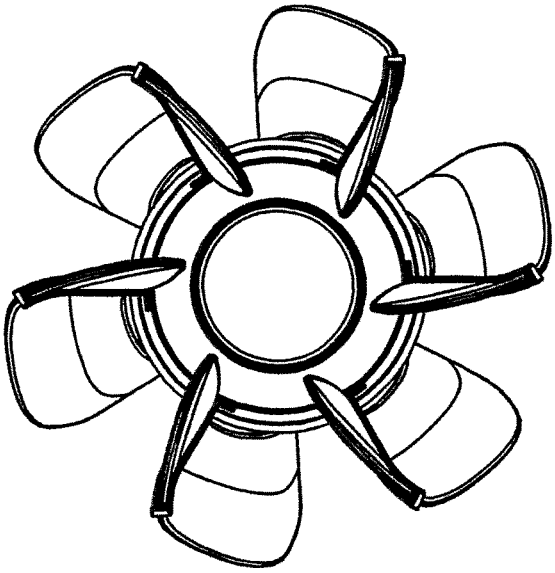
Figure 16:
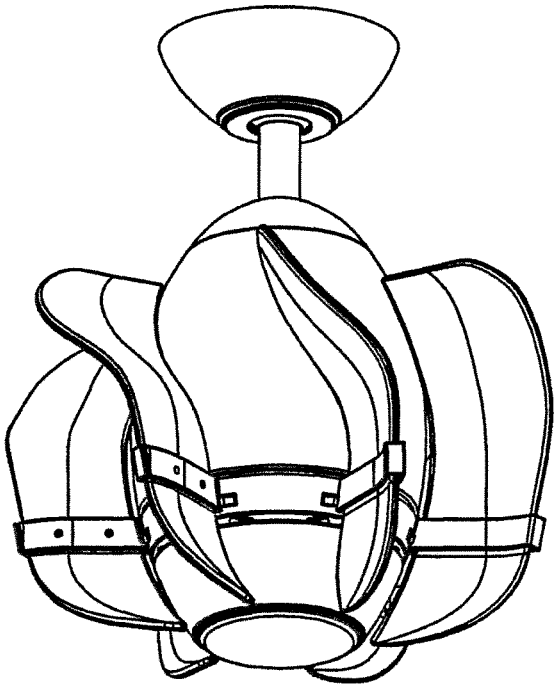
Figure 17:
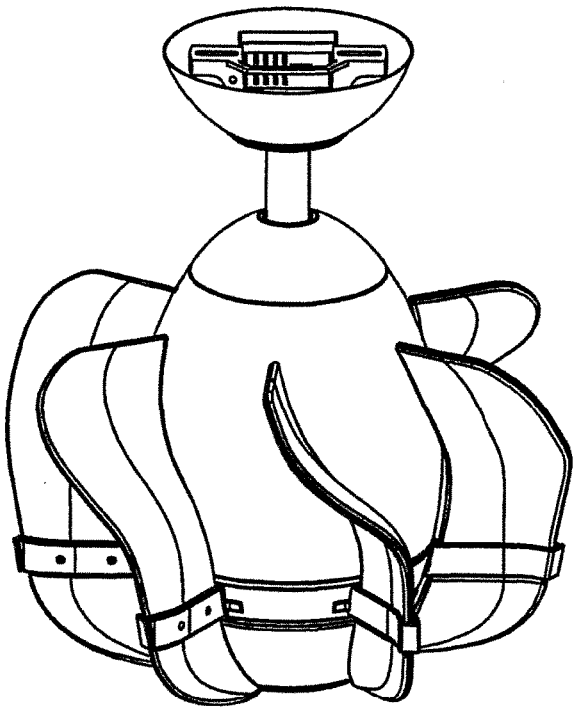
Figure 18A:
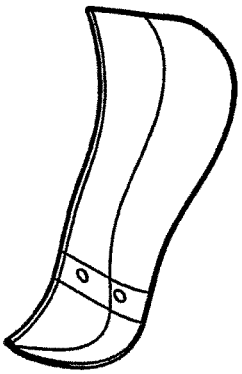
Figure 18B:
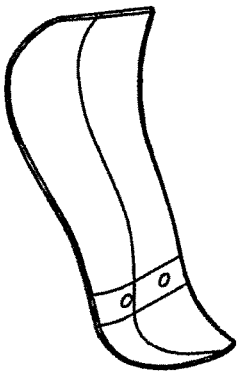
Figure 19A:
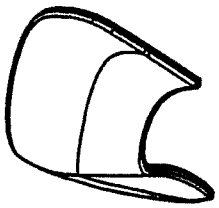
Figure 19B:
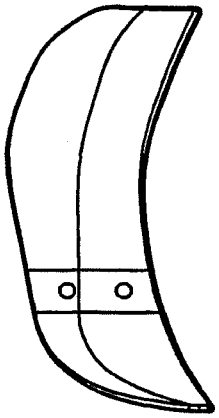
Figure 19C:
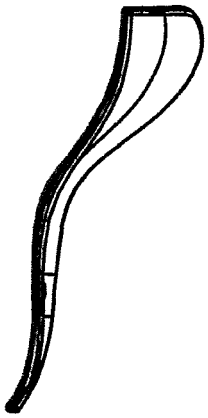
Figure 19D:
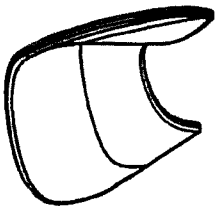
Figure 20:
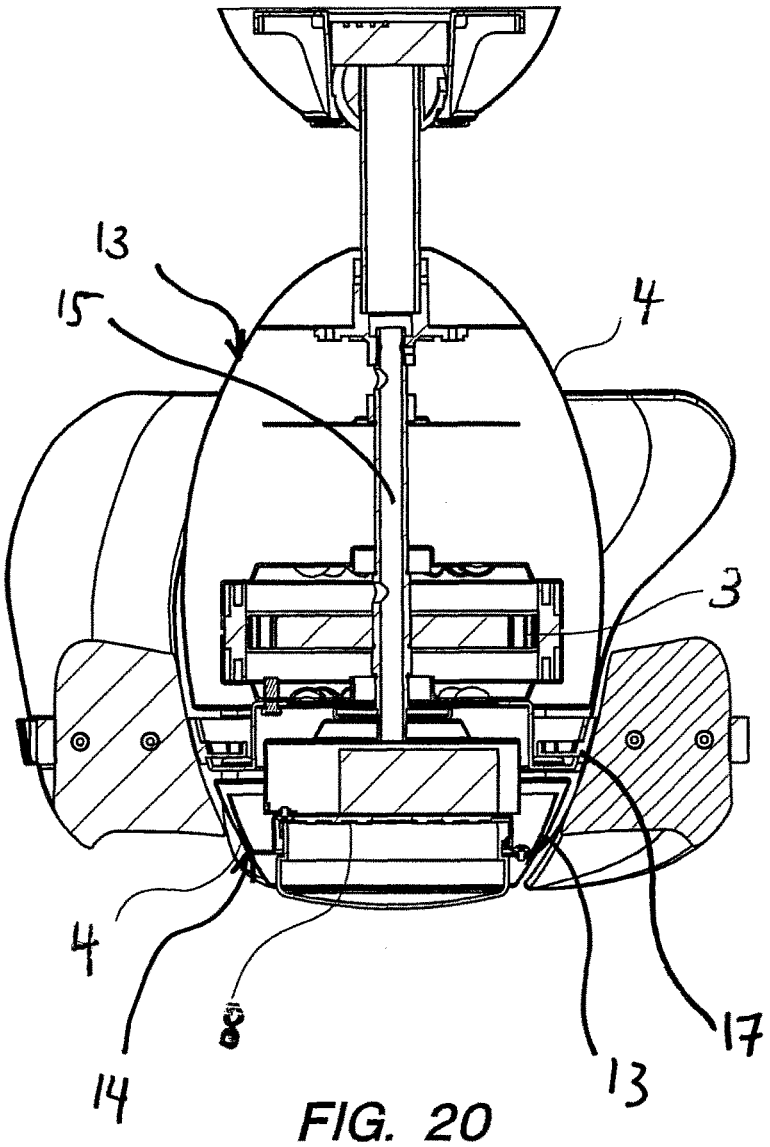
FIG. 20 is a vertical sectional view of the fan of FIGS. 10-19.
Figure 21:
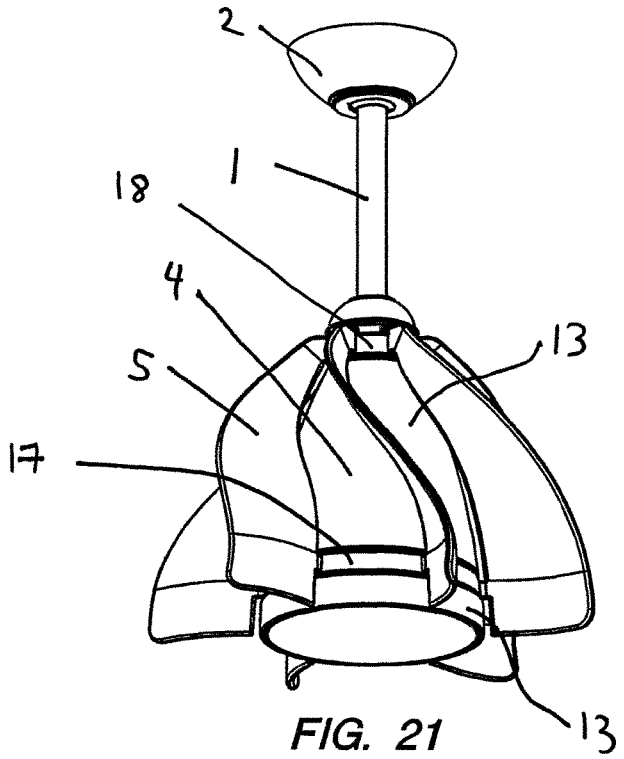
FIG. 21 is a front/bottom view of an exemplary fan (CP138865).
Figure 22:
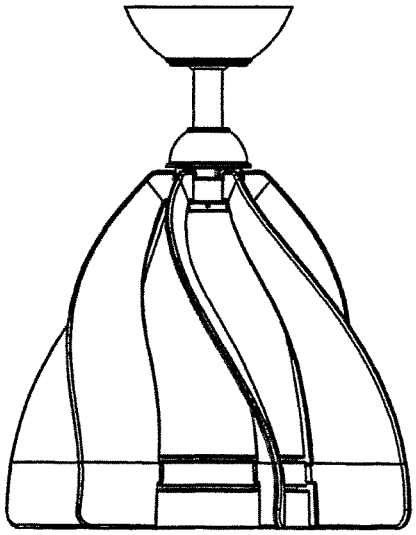
FIGS. 22-35 are various views of a similar fan and views of the blades of this fan (the blades are identical) (CP138865).
Figure 23:
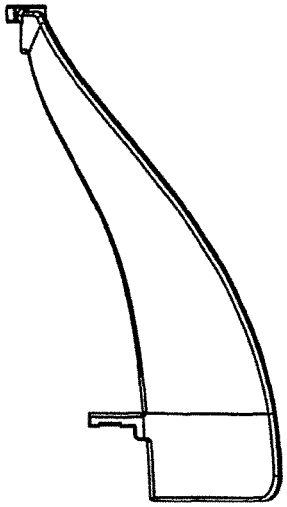
Figure 24:
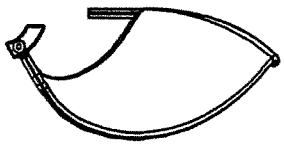
Figure 25:
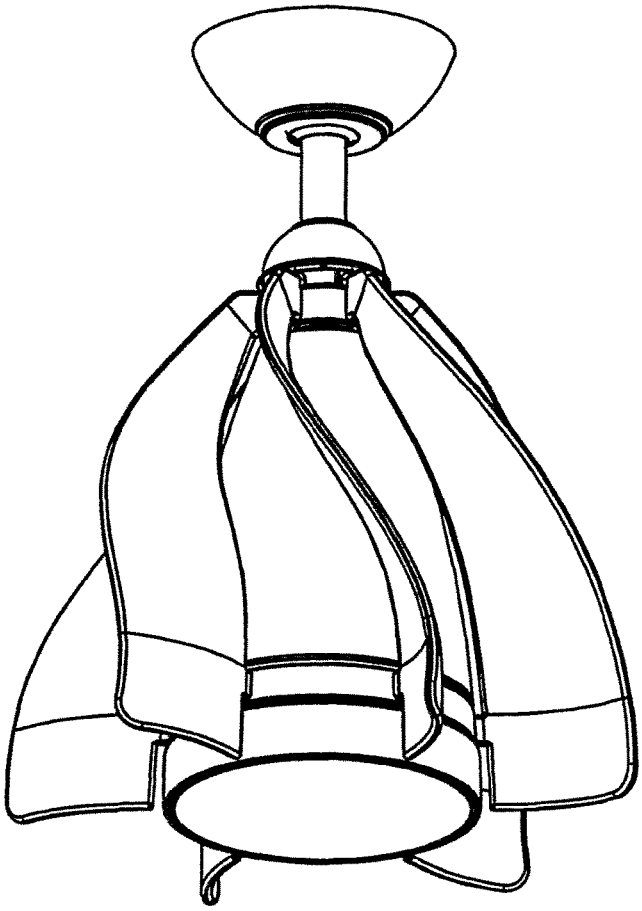
Figure 26:
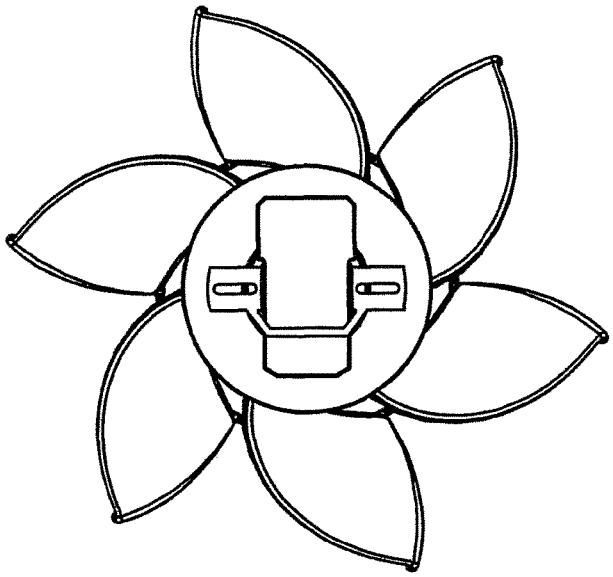
Figure 27:
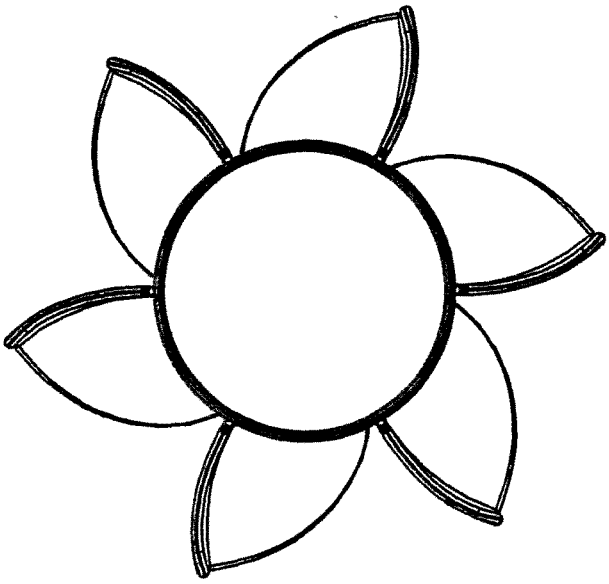
Figure 28:
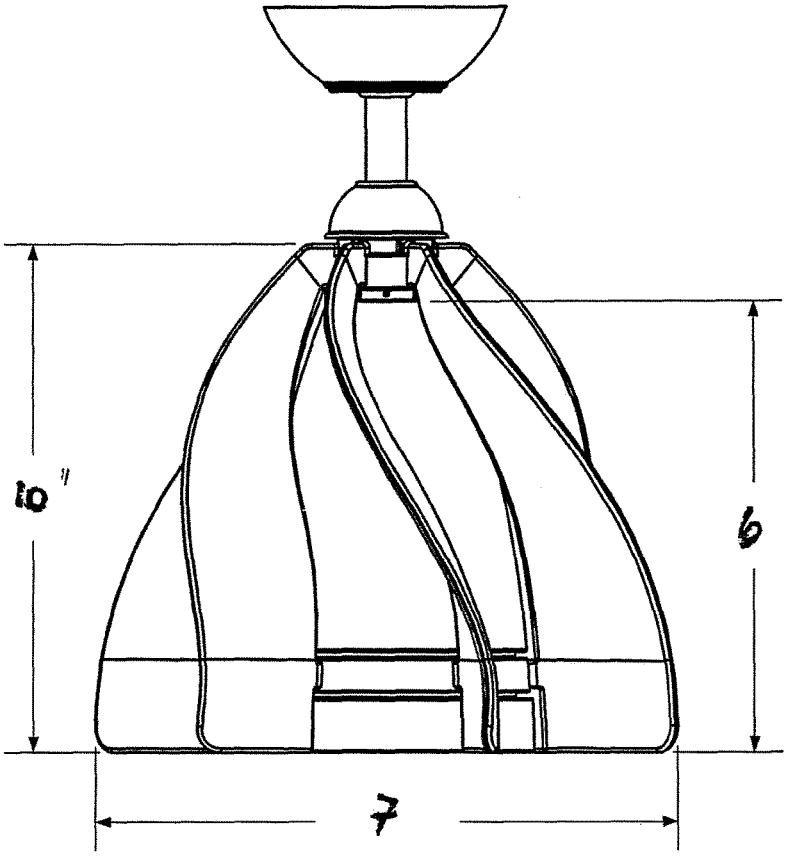
Figure 29:
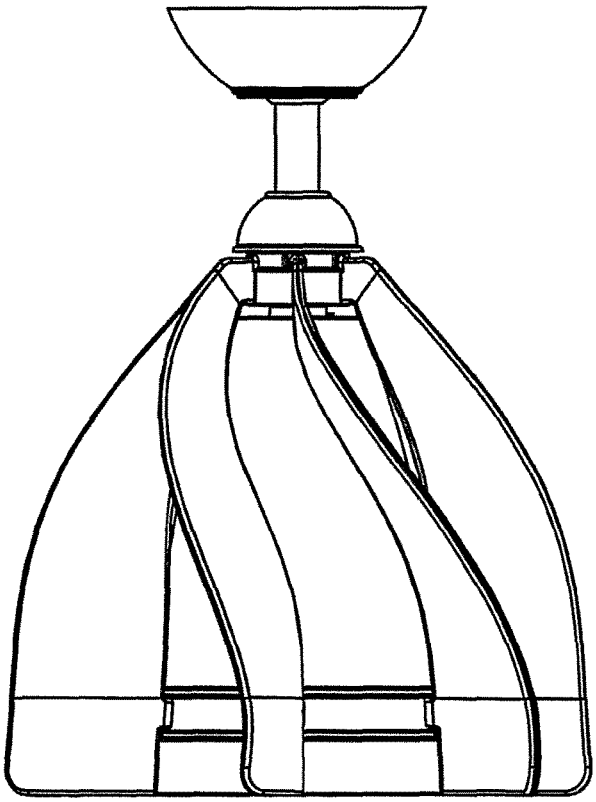
Figure 30:
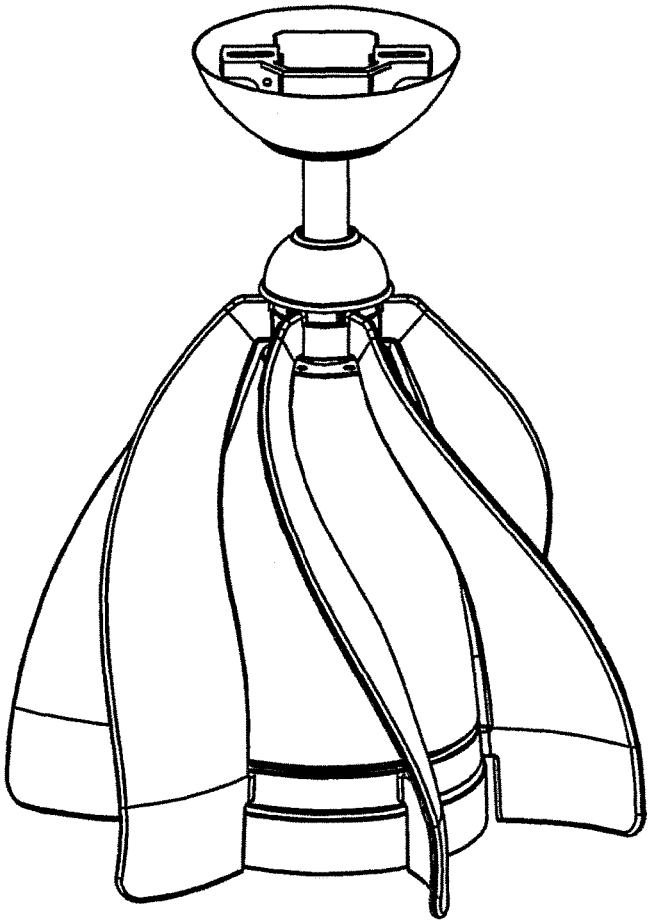
Figure 31:
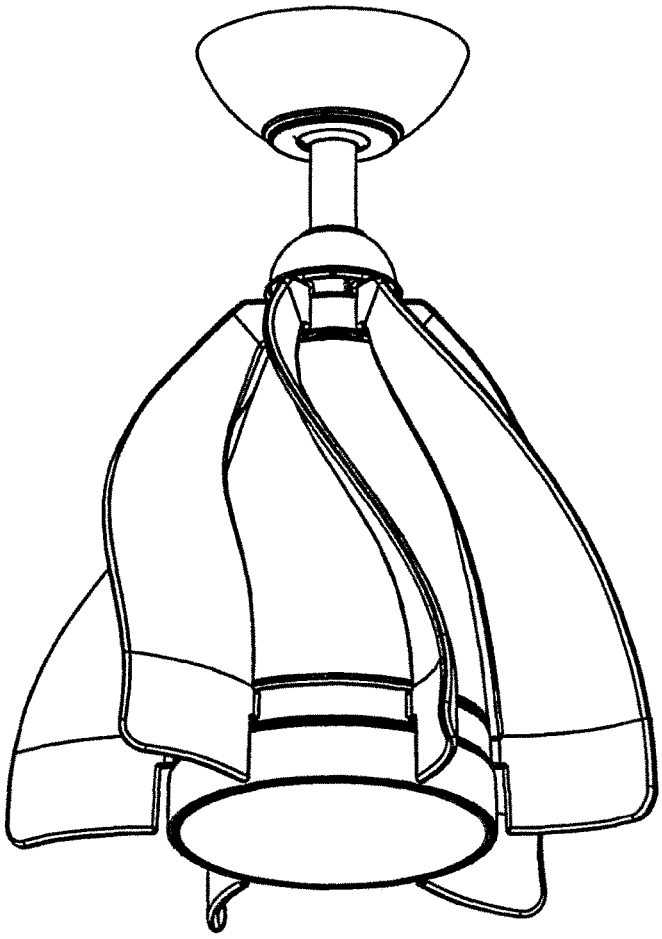
Figure 32:
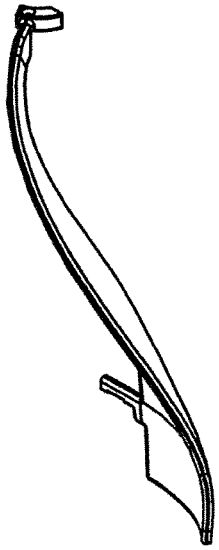
Figure 33:
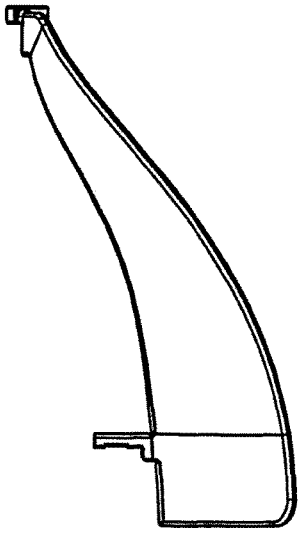
Figure 34:
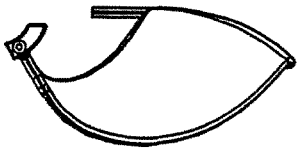
Figure 35:
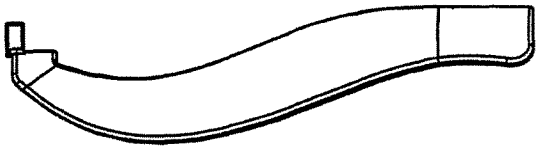

The exemplary fans of FIGS. 1-8 have two hubs—one above the housing and one below the housing. "Hub" as used herein is a center part of a wheel, fan, or propeller. The fans of FIGS. 1-8 have two hubs along the axis of rotation of the motor, which will be a central axis, one hub positioned above the motor and one hub positioned below the motor. In the exemplary fans of FIGS. 1-8, the bottom hub is driven by the motor, as can be seen in FIG. 8. The upper hub has bearings to permit smooth operation, but the upper hub does not drive the blades. In the alternative, the exemplary fans of FIGS. 1-8 can be modified so that the upper hub drives the blades instead of (or in addition to) the lower hub. The housing in the exemplary fans of FIGS. 1-8 includes two hemispherical housing pieces that connect to form a generally spherical housing that encloses the motor. The housing in the exemplary fans of FIGS. 1-8 does not move, but in other embodiments either or both pieces can be modified to move with the blades. The drive shaft extends through an opening 16 in the bottom of the lower housing piece. The housing or the bottom portion of the housing can be made of transparent or translucent material to permit a light source inside the housing (e.g., a plurality of LEDs and a driver circuit) to illuminate an area around and below the fan with light passing through the housing.

In the exemplary fans of FIGS. 1-8, the upper end of each of the plurality of fan blades is proximate the down rod, the lower end of each of the plurality of fan blades is proximate the drive shaft, which is coaxial with the down rod, and a majority of the radially inner edge of each of the plurality of fan blades is about 2" inches from the housing at all points. In the exemplary fans of FIGS. 1-8, the entire radially inner edge of (or a majority thereof or at least 75% of) each of the plurality of fan blades can be about ½ inches from the housing at all points. In alternate exemplary embodiments, the radially inner edge of each of the plurality of fan blades is about 1½-2½ inches from the housing at all points. In alternate exemplary embodiments, the entire radially inner edge of (or a majority thereof or at least 75% of) each of the plurality of fan blades is less than 1½ inches from the housing at all points.

In FIG. 1, the fan blades are planar and curve out from a hub at the drive shaft, up around the housing, and meet at a hub above the housing in the same plane. In FIGS. 2A-8, the fan blades are not planar and curve out from a hub at the drive shaft, up around the housing, and meet at a hub above the housing at a location that is about 72 degrees rotated with respect to the bottom hub attachment point. In alternative exemplary embodiments, the fan blades are not planar and curve out from a hub at the drive shaft, up around the housing, and meet at a hub above the housing at a location that is about 60-80 degrees rotated with respect to the bottom hub attachment point. The plurality of blades extend outward radially from a lower central bracket, up and around at least a portion of the housing and back inward radially to meet at a central upper bracket 18 rotationally connected to the down rod above the motor to support the plurality of blades at the top with the upper and lower brackets. The fans blades can be affixed to the brackets using screws.

The fan of FIG. 1 has six (6) identical blades and has preferably has six-way, sixty degree overall rotational symmetry. The fan of FIGS. 2A-8 has five identical blades and preferably has five-way, seventy-two degree overall rotational symmetry. Of course, a fan with more blades or fewer blades could be made using the teachings herein.

The exemplary fans of FIGS. 1-8 are compact. More specifically, the exemplary fans of FIGS. 1-8 are about 8.6" high (height of the housing 6) and have a blade span diameter of about twice that measurement, giving them a blade span diameter 7 to housing height ratio of about 2:1. Exemplary Fans made in accordance with the teachings of this disclosure can have a blade span diameter to housing height ratio of about 1.8:1 to about 2.2:1 (or less, i.e., lower blade span diameter), making them compact. Additionally, the exemplary fans of FIGS. 1-8 are about as high in overall height 10 (blades and housing) as they are wide (blade span diameter), giving them a blade span diameter to overall height ratio of about 1:1. Exemplary Fans made in accordance with the teachings of this disclosure can have a blade span diameter to overall height ratio of about ½:1 to about 1½:1 (or less, i.e., lower blade span diameter), making them compact. Alternate exemplary Fans made in accordance with the teachings of this disclosure can have a blade span diameter to overall height ratio of about ¾:1 to about 1¾:1, making them compact.

The blades of the fans of FIGS. 1-8 can be made of Acrylic or ABS or Wood or any other material commonly used to make ceiling fan blades suitable for a blade affixed to a bracket with Screws.

FIGS. 9-20 show various images of two exemplary fans (CP138869). The exemplary fans of FIGS. 9-20 are fans suspended by a down rod 1 held by a hanger bracket 2 including a down rod having a longitudinal axis and comprising at least one member; and a motor 3 having a non-moving portion 13 affixed to the down rod, the motor further having a moving portion 14 that rotates a plurality of blades around a drive axis 15 of the motor; a housing 4 that encloses at least a portion of the motor; and wherein the plurality of blades 5 each comprises an upper end, a lower end, a radially inner edge, and a radially outer edge; and wherein the upper end of each of the plurality of fan blades is proximate at least one of the housing and the down rod; and wherein the lower end of each of the plurality of fan blades is proximate at least one of the housing and the down rod; and wherein a majority of the radially inner edge of each of the plurality of fan blades is less than an inch or a half-inch or a quarter-inch from the housing.

The exemplary fans of FIGS. 9-20 have a single hub that divides the housing into three portions, a moving ring-shaped portion ("collar") 17 of the housing that rotates with the arms carrying the blades, a non-moving portion of the housing above the moving ring-shaped portion, and a non-moving portion of the housing below the moving ring-shaped portion, each of which is a separate piece. The fans of FIGS. 9-20 have a single hub, which is at the motor. The housing or the bottom portion of the housing or a distal end of the bottom portion of the housing can be made of transparent or translucent material to permit a light source inside the housing (e.g., a plurality of LEDs and a driver circuit) to illuminate an area around and below the fan with light passing through that transparent or translucent portion of the housing.

In the exemplary fans of FIGS. 9-20, a majority of the radially inner edge of each of the plurality of fan blades is about ½ inches from the housing at all points. In the exemplary fans of FIGS. 9-20, the entire radially inner edge of (or a majority thereof or at least 75% of) each of the plurality of fan blades can be about ½ inches from the housing at all points. In alternate exemplary embodiments, the entire radially inner edge of (or a majority thereof or at least 75% of) each of the plurality of fan blades is about ¼-¾ inches from the housing at all points. In alternate exemplary embodiments, the entire radially inner edge of (or a majority thereof or at least 75% of) each of the plurality of fan blades is less than 1½ inches from the housing at all points.

In FIGS. 9-20, the fan blades 5 are not planar and curve out from a hub at the motor curve above and around the housing at a location that is about 45 degrees rotated with respect to the bottom hub attachment point. In alternative exemplary embodiments, the fan blades are not planar and curve out from a hub at the motor curve above and around the housing at a location that is about 35-60 degrees rotated with respect to the bottom hub attachment point.

The fans of FIGS. 9-20 have six (6) identical blades and has preferably have six-way, sixty degree overall rotational symmetry. Of course, a fan with more blades or fewer blades could be made using the teachings herein.

The exemplary fans of FIGS. 9-20 are compact. More specifically, the exemplary fans of FIGS. 9-20 are about 11" high (height of the housing) and have a blade span diameter of about 14", giving them a blade span diameter to housing height ratio of about 1¼:1, making it compact. Fans made in accordance with the teachings of this disclosure can have a blade span diameter 7 to housing height 6 ratio of about 1:1 to about 1½:1 (or less, i.e., lower blade span diameter), making them compact. Additionally, in the exemplary fans of FIGS. 9-20, the overall height 10 (blades and housing) is the same as the height of the housing (as compared to the fans of FIGS. 1-9, where the blades extend above and below the housing), so the blade span diameter to overall height ratio is the same, about 1¼:1. Exemplary Fans made in accordance with the teachings of this disclosure can have a blade span diameter to overall height ratio of about 1:1 to about 1½:1 (or less, i.e., lower blade span diameter), making them compact Alternate exemplary Fans made in accordance with the teachings of this disclosure can have a blade span diameter to overall height ratio of about ¾:1 to about 1¾:1, making them compact.

The blades of the fans of FIGS. 9-20 can be made of Acrylic, ABS or wood or any other material commonly used to make ceiling fan blades. The arms used to hold the fan blades of the fans of FIGS. 9-20 can be made of Zinc or Aluminum and are fastened to the blades using Screws.

FIGS. 21-36 show various images of two exemplary fans (CP138865). The exemplary fans of FIGS. 21-36 are ceiling fans suspended by a down rod 1 held by a hanger bracket 2 including a down rod having a longitudinal axis and comprising at least one member; a motor 3 having a non-moving portion 13 affixed to the down rod, the motor further having a moving portion 14 affixed to a drive shaft 15 extending down from the moving portion of the motor, the drive shaft positioned coaxially with the down rod, and the drive shaft comprising at least one coaxial member; a housing 4 that encloses at least a portion of the motor; and a plurality of blades 5 rotationally driven by the downwardly extending drive shaft, the blades extending outward radially up and around at least a portion of the housing and back inward radially to meet at a central point 18 proximate a portion of the down rod above the motor.

The exemplary fans of FIGS. 21-36 are also fans suspended by a down rod held by a hanger bracket including a down rod having a longitudinal axis and comprising at least one member; and a motor having a non-moving portion affixed to the down rod, the motor further having a moving portion that rotates a plurality of blades around a drive axis of the motor; a housing that encloses at least a portion of the motor; and wherein the plurality of blades each comprises an upper end, a lower end, a radially inner edge, and a radially outer edge; and wherein the upper end of each of the plurality of fan blades is proximate at least one of the housing and the down rod; and wherein the lower end of each of the plurality of fan blades is proximate at least one of the housing and the down rod; and wherein a majority of the radially inner edge of each of the plurality of fan blades is less than an inch or a half-inch or a quarter-inch from the housing.

Figure 36:
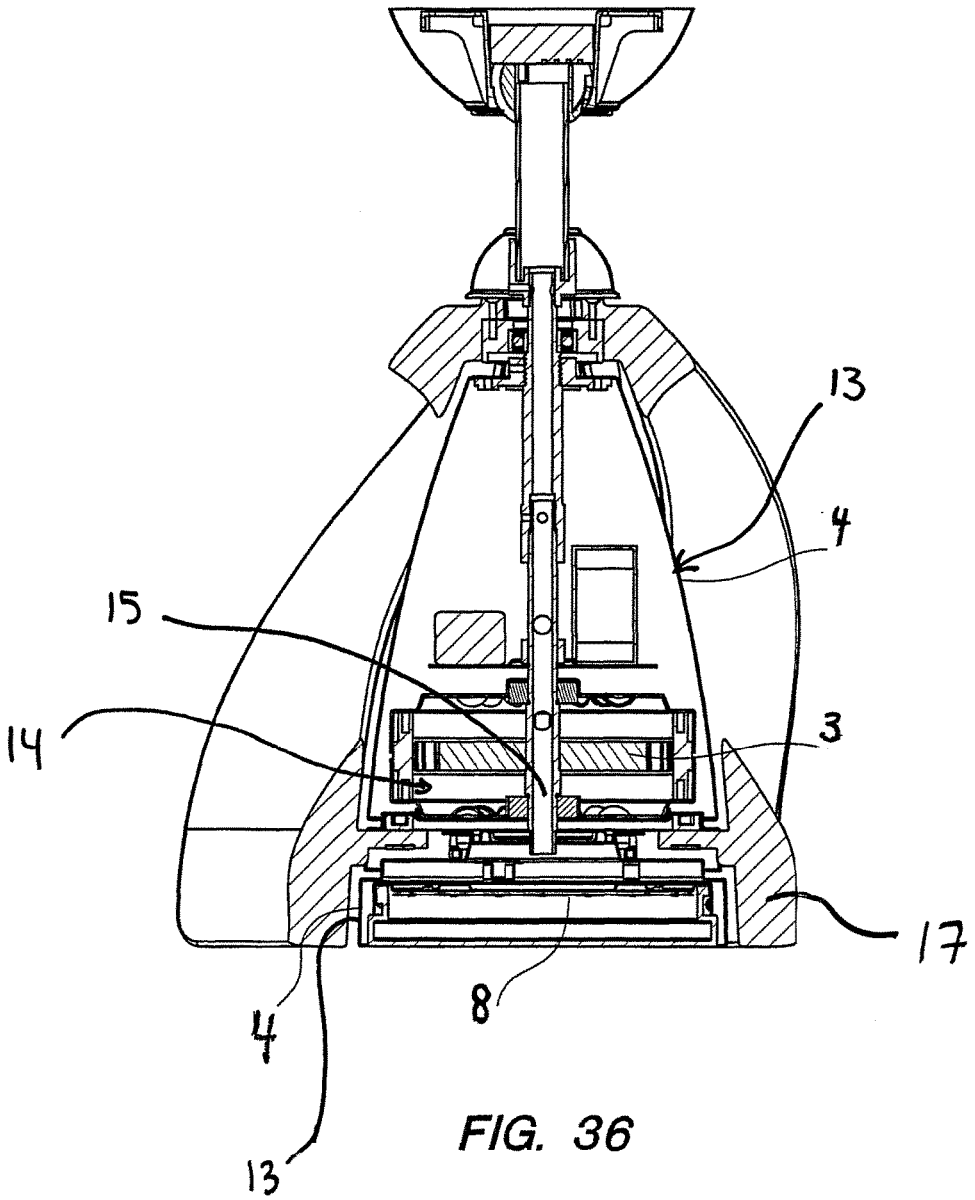
FIG. 36 is a vertical sectional view of the fan of FIGS. 22-35.
Figure 37:
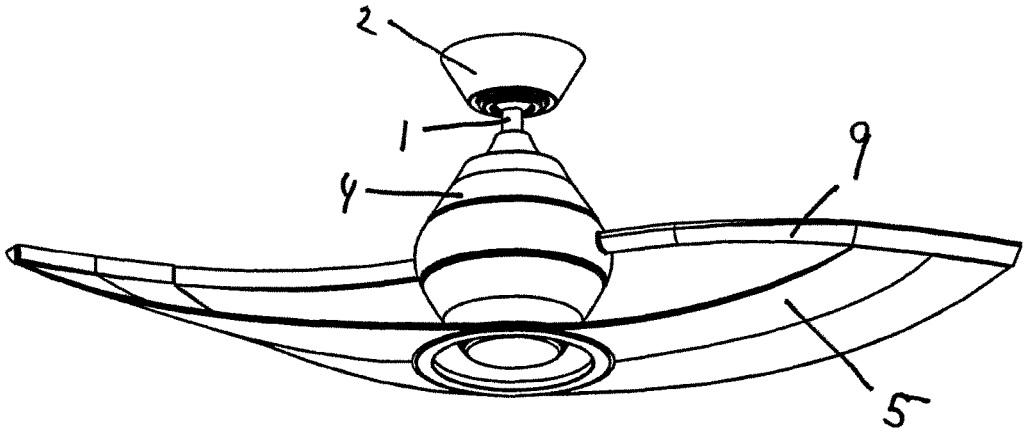
FIG. 37 is a front/bottom view of an exemplary fan (CP138865).
Figure 38:
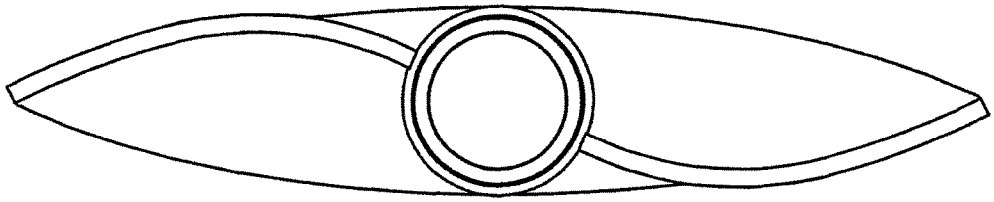
FIGS. 38-57 are various views of a similar fan and views of the blades of this fan (the blades are identical) (CP138865).
Figure 39:
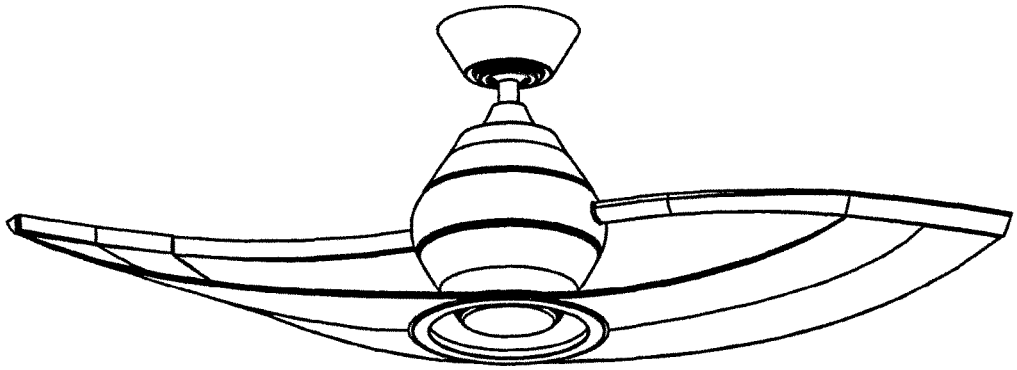
Figure 40:
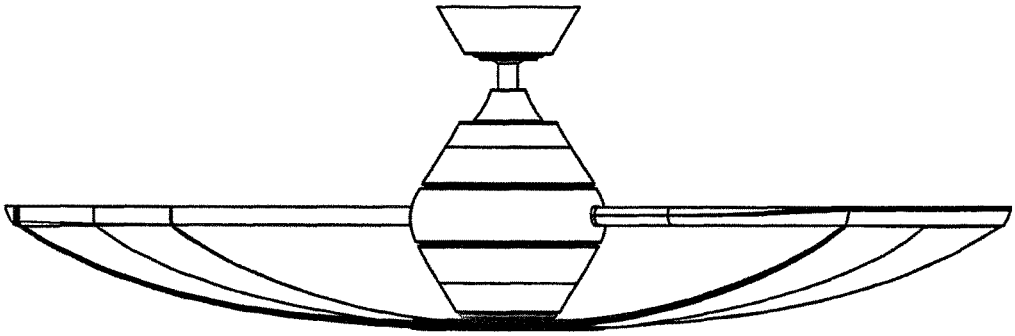
Figure 41:
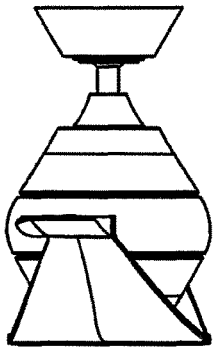
Figure 42:
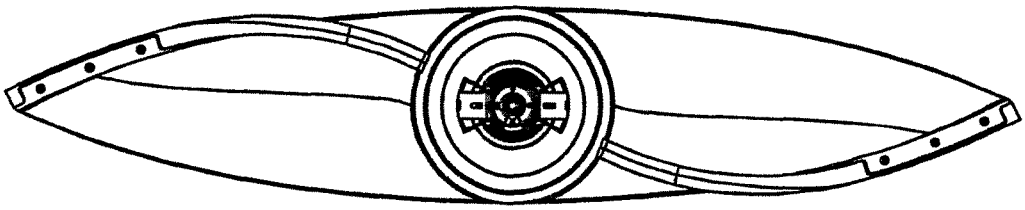
Figure 43:
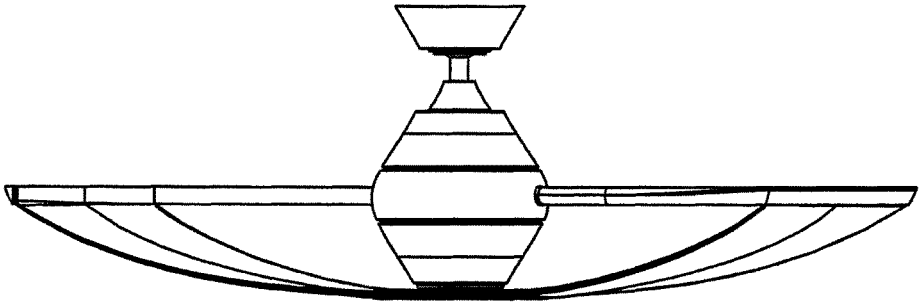
Figure 44:
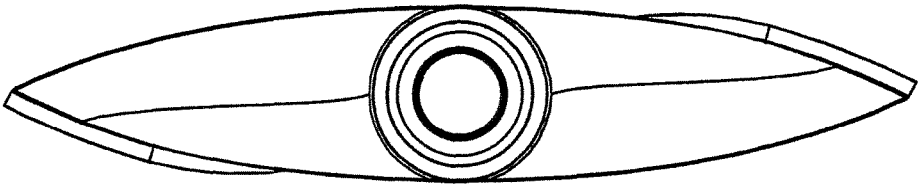
Figure 45:
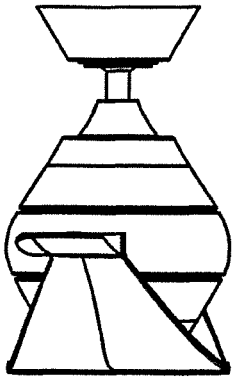
Figure 46:
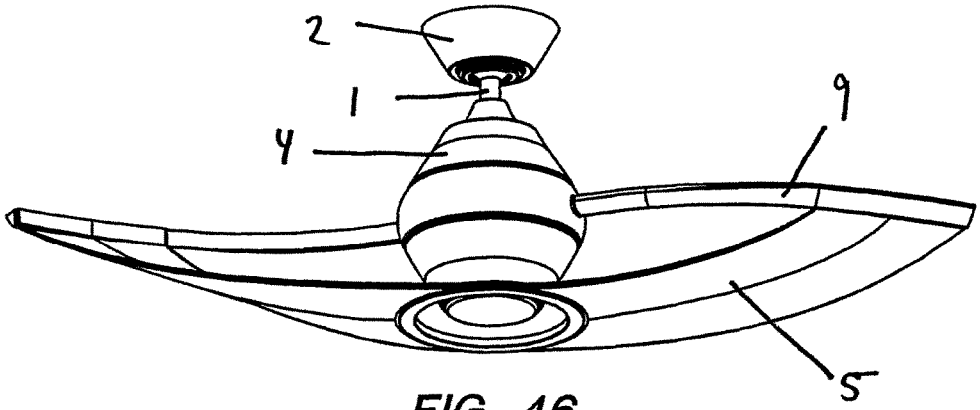
Figure 47:
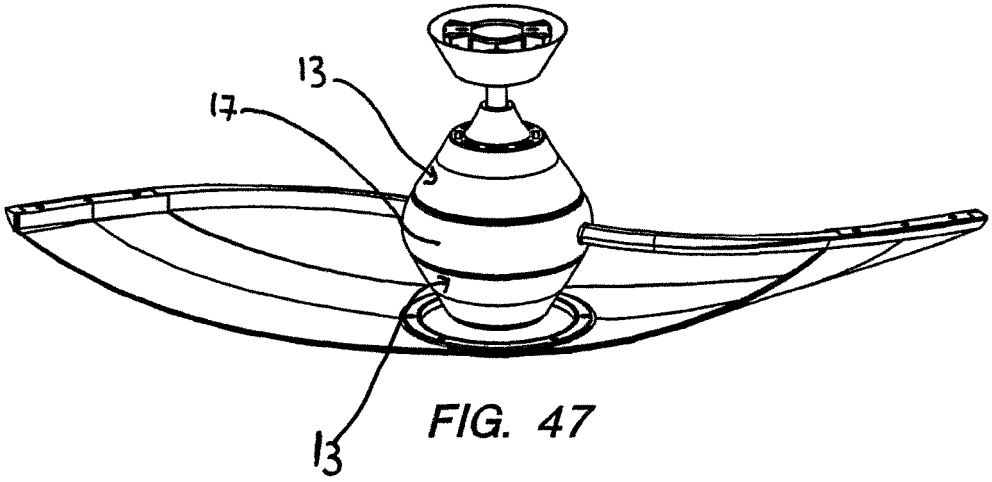
Figure 48:
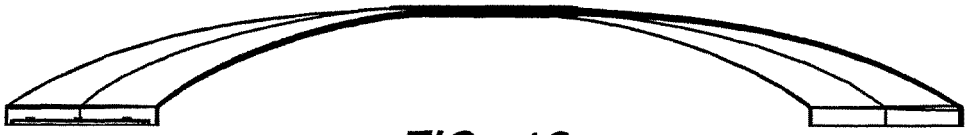
Figure 49:
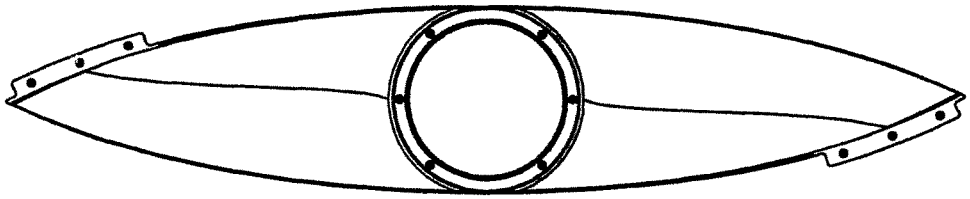
Figure 50:
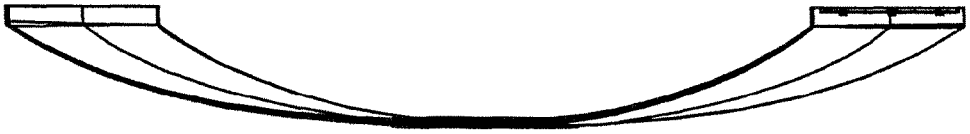

The exemplary fans of FIGS. 21-36 have two hubs—one above the housing and one at the motor. The fans of FIGS. 21-36 have two hubs along the axis of rotation of the motor, which will be a central axis, one hub positioned above the motor and one hub positioned at the motor. In the exemplary fans of FIGS. 21-36, the bottom hub is driven by the motor, as can be seen in FIG. 36. The upper hub has bearings to permit smooth operation, but the upper hub does not drive the blades. In the alternative, the exemplary fans of FIGS. 21-36 can be modified so that the upper hub drives the blades instead of (or in addition to) the lower hub. The bottom hub divides the housing into three portions, a moving ring-shaped portion ("collar") 17 of the housing that rotates with the arms carrying the blades, a non-moving portion 13 of the housing above the moving ring-shaped portion, and a non-moving portion 13 of the housing below the moving ring-shaped portion, each of which is a separate piece. The housing or the bottom portion of the housing or a distal end of the bottom portion of the housing can be made of transparent or translucent material to permit a light source 8 inside the housing (e.g., a plurality of LEDs and a driver circuit) to illuminate an area around and below the fan with light passing through that transparent or translucent portion of the housing.

In the exemplary fans of FIGS. 21-36, the upper end of each of the plurality of fan blades is proximate the down rod, the lower end of each of the plurality of fan blades is proximate the motor, which is coaxial with the down rod, and a majority of the radially inner edge of each of the plurality of fan blades is about ½ inches from the housing at all points. In the exemplary fans of FIGS. 21-36, the entire radially inner edge of (or a majority thereof or at least 75% of) each of the plurality of fan blades can be about ½ inches from the housing at all points. In alternate exemplary embodiments, the entire radially inner edge of (or a majority thereof or at least 75% of) each of the plurality of fan blades is about ¼-¾ inches from the housing at all points. In alternate exemplary embodiments, the entire radially inner edge of (or a majority thereof or at least 75% of) each of the plurality of fan blades is less than 1½ inches from the housing at all points.

In FIGS. 21-36, the fan blades are not planar and curve out from a hub at the motor curve above and around the housing at a location that is about 30 degrees rotated with respect to the bottom hub attachment point. In alternative exemplary embodiments, the fan blades are not planar and curve out from a hub at the motor curve above and around the housing at a location that is about 20-45 degrees rotated with respect to the bottom hub attachment point The plurality of blades extend outward radially from a lower central bracket, up and around at least a portion of the housing and back inward radially to meet at a central upper bracket 18 rotationally connected to the down rod above the motor to support the plurality of blades at the top with the upper and lower brackets.

The fans of FIGS. 21-36 have six (6) identical blades and has preferably have six-way, sixty degree overall rotational symmetry. Of course, a fan with more blades or fewer blades could be made using the teachings herein.

The exemplary fans of FIGS. 21-36 are compact. More specifically, the exemplary fans of FIGS. 21-36 have a blade span diameter 7 to housing height 6 ratio of about 1¼:1, making it compact. Exemplary fans made in accordance with the teachings of this disclosure can have a blade span diameter to housing height ratio of about 1:1 to about 1½:1 (or less, i.e., lower blade span diameter), making them compact. Exemplary Fans made in accordance with the teachings of this disclosure can have a blade span diameter to housing height ratio of about ¾:1 to 1¾:1 (or less, i.e., lower blade span diameter), making them compact. Additionally, the exemplary fans of FIGS. 21-36 have a blade span diameter to overall height ratio of about 1⅛:1. Exemplary Fans made in accordance with the teachings of this disclosure can have a blade span diameter to overall height 10 ratio of about ⅞:1 to about 1⅝:1 (or less, i.e., lower blade span diameter), making them compact. Alternate exemplary Fans made in accordance with the teachings of this disclosure can have a blade span diameter to overall height ratio of about ¾:1 to 1¾:1 (or less, i.e., lower blade span diameter), making them compact.

The blades of the fans of FIGS. 21-36 can be made of Acrylic, ABS or Wood or any other material commonly used to make ceiling fan blades suitable for a blade with an integral arm that extends through a housing collar and to (and is affixed to) a rotating portion affixed to a motor.

Although many ceiling fans generate a vertical airflow, the fan embodiments of FIGS. 1-36 herein generate an airflow pattern that is primarily in the direction of about 45-60 degrees down from the horizontal.

FIGS. 37-60 show various images of two exemplary fans (CP138856). The exemplary fans of FIGS. 37-60 are ceiling fans suspended by a down rod 1 held by a hanger bracket 2 including a down rod having a longitudinal axis and comprising at least one member; a motor 3 having a non-moving portion 13 affixed to the down rod, the motor further having a moving portion 14 that rotates at least first and second arms around a drive axis 15 of the motor; a housing 4 that encloses at least a portion of the motor, the arms extending radially outward; and a fan blade 5 having first and second ends supported by the first and second arms 9, respectively, the first end of the fan blade affixed to a distal end of the first arm, and the second end of the fan blade affixed to a distal end of the second arm; and the fan blade extending down from the distal end of the first arm, extending under the housing, and extending back up to the distal end of the second arm, the fan blade being unsupported by the housing and unsupported by the motor. In this exemplary fan, the fan blade is unsupported by the housing and us unsupported by the arms, except at their respective distal ends. As can be seen in the figures, the fan blade is at their respective distal ends along about one quarter the length of the arms. In exemplary embodiments, the fan blade is at the respective distal ends of the arms along about one third to one eighth the length of the arms. In exemplary embodiments, the fan blade is at the respective distal ends of the arms along about one half to one tenth the length of the arms.

Figure 51:
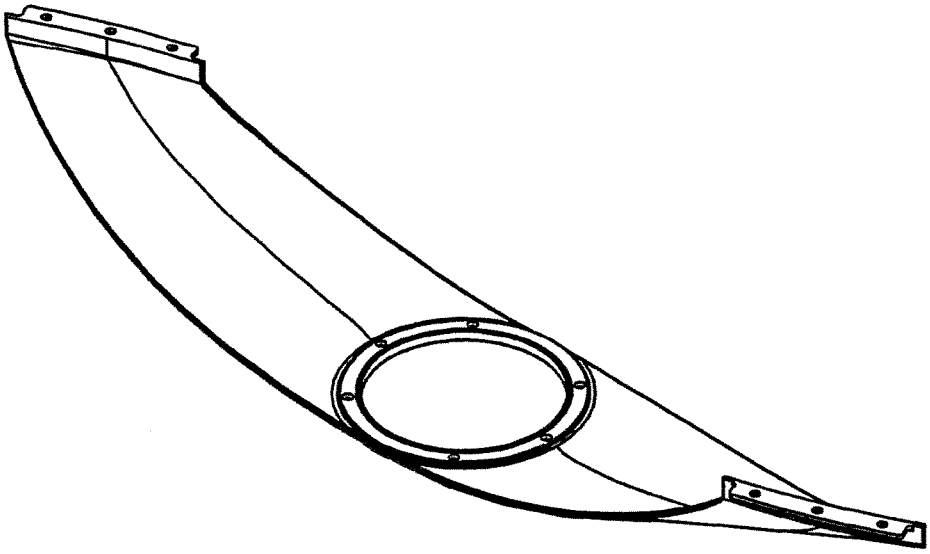
Figure 52:
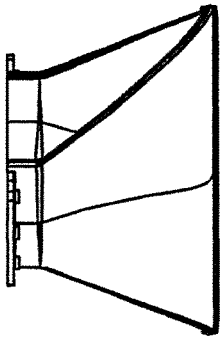
Figure 53:
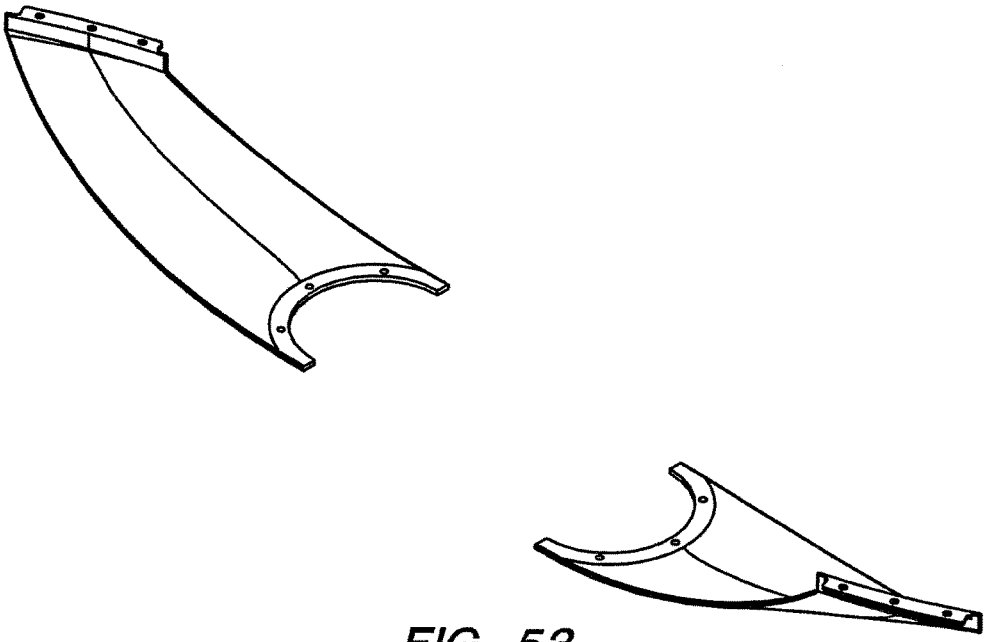
Figure 54:
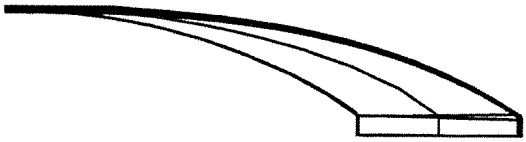
Figure 55:
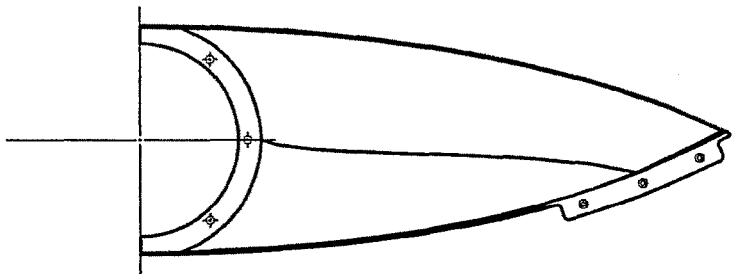
Figure 56:
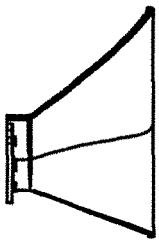
Figure 57:
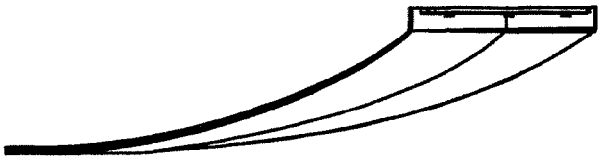
Figure 58:
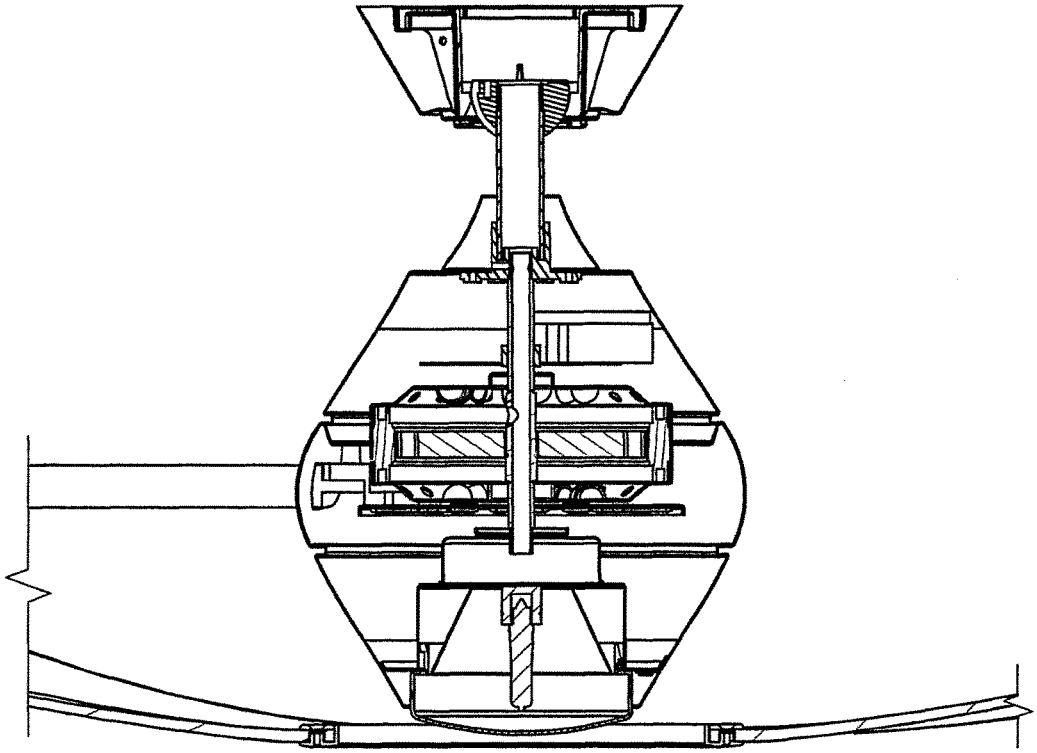
FIGS. 58-60 are vertical sectional views of the fan of FIGS. 38-57.
Figure 59:
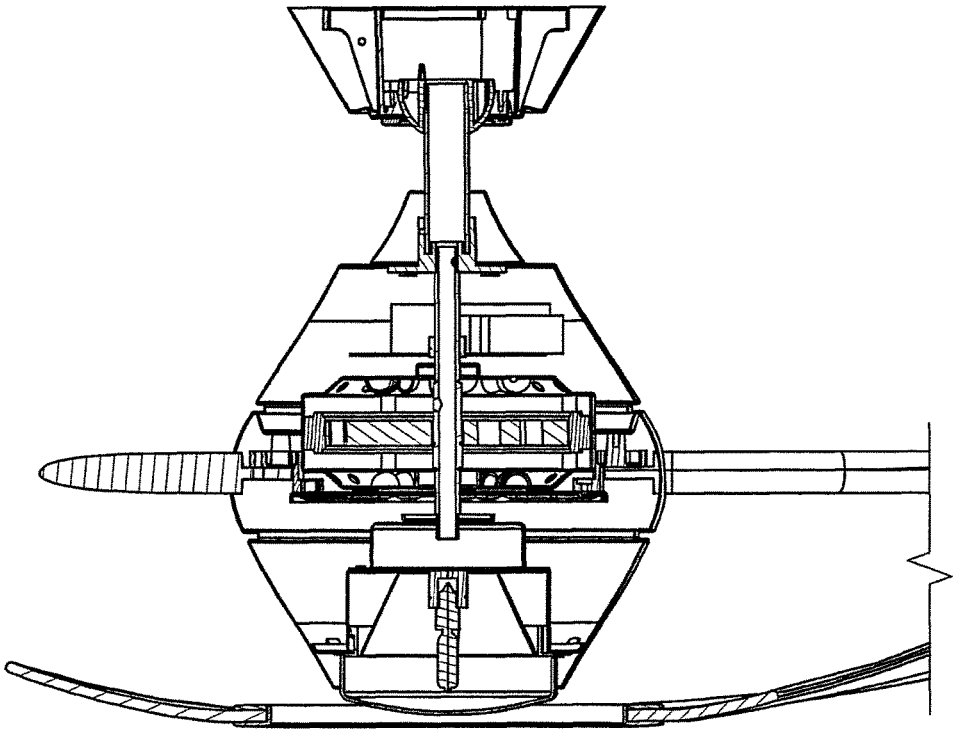
Figure 60:
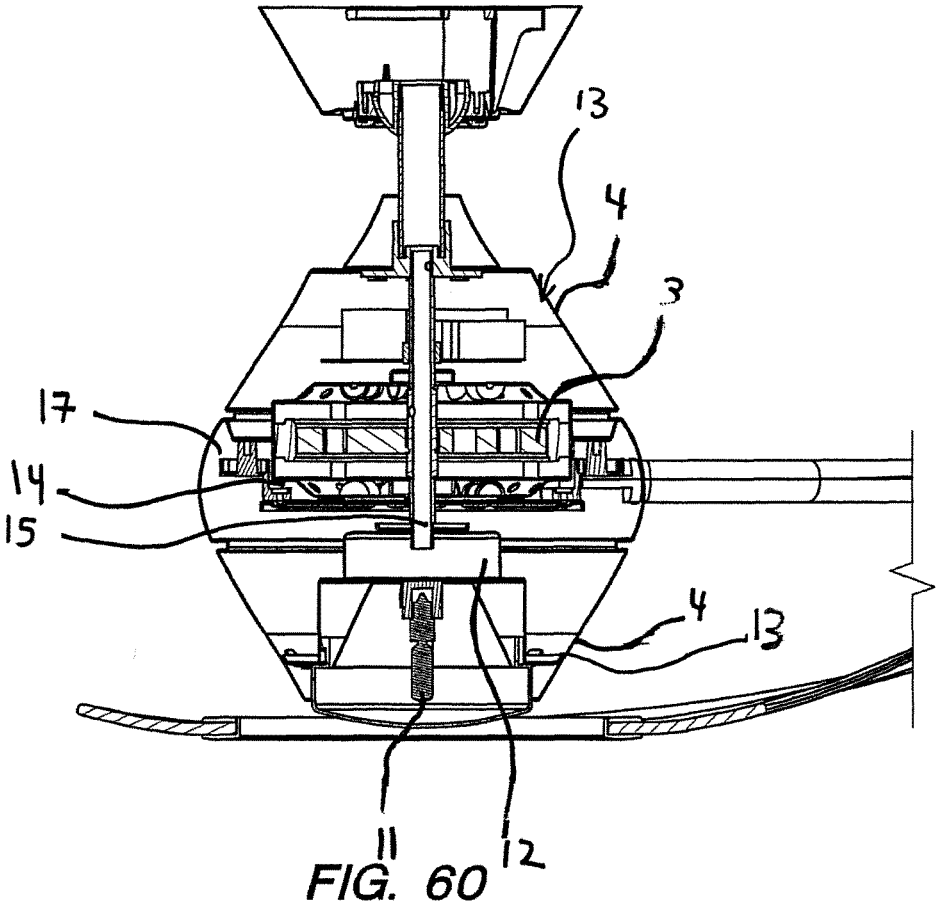

The exemplary fans of FIGS. 37-60 have a single hub that divides the housing into three portions, a moving ring-shaped portion ("collar") 17 of the housing that rotates with the arms carrying the blade, a non-moving portion of the housing above the moving ring-shaped portion, and a non-moving portion of the housing below the moving ring-shaped portion, each of which is a separate piece. The fans of FIGS. 37-60 have a single hub, which is at the motor. The housing or the bottom portion of the housing or a distal end of the bottom portion of the housing can be made of transparent or translucent material to permit a light source inside the housing (e.g., a bulb 11 (and/or LEDs) and a driver circuit 12) to illuminate an area around and below the fan with light passing through that transparent or translucent portion of the housing. An opening in the blade permits light to pass down to the area below the fan. FIG. 51 shows a support ring that is affixed to the two blade halves to connect the blade halves and provide the opening down through which the light is transmitted. More specifically, a pair of support rings made of Zinc or Aluminum sandwich the material of the two blade halves and are connected with Screws.

The fans of FIGS. 37-60 have two (2) identical arms 9, and a single blade 5, and has preferably have two-way, one hundred and eighty degree overall rotational symmetry. Of course, a fan with more blades (e.g., four arms spaced ninety degrees apart and two blades extending between opposite arms like the ones herein (or adjacent arms)) could be made using the teachings herein.

As seen in top views, the arms are curved and the blade appears to have two edges that are sections of a circle. The arms can be made of 1"×1" Steel or Aluminum stock bent as shown and the blade can be made of Acrylic, Aluminum or Wood. In this particular embodiment, the blade is affixed along the distal ends of the arms using fasteners, e.g., Screws, as seen in the top views.

Except as identified above, the components of the fans herein can be made with any of the various plastic, metal, and wood materials common for their respective component.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, different lighting components used (incandescent vs LED, or no lighting) and/or different blade materials. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

What is claimed is:

1. A ceiling fan suspended by a down rod held by a hanger bracket, comprising:

a. a down rod having a longitudinal axis and comprising at least one member;

b. a motor having a non-moving portion affixed to the down rod, the motor further having a moving portion affixed to a drive shaft extending down from the moving portion of the motor, the drive shaft positioned coaxially with the down rod, and the drive shaft comprising at least one coaxial member;

c. a housing that encloses at least a portion of the motor; and d. a plurality of blades rotationally driven by the downwardly extending drive shaft, each blade comprising an upper end, a lower end, a fan blade body longitudinally extending between the upper end and the lower end, a radially inner edge extending longitudinally, and a radially outer edge, the radially inner edge of each blade having a concave shape to accommodate the housing, and each of the blades extends outward radially from the drive shaft at the lower end, curves up and around at least a portion of the housing, and curves back inward radially to meet at a central point with the upper end above the motor and proximate the down rod.

2. The ceiling fan according to claim 1, wherein the drive shaft extends down through an opening in the housing to connect to the lower ends of the plurality of fan blades.

3. The ceiling fan according to claim 2, wherein there is a central bracket rotationally connected to the down rod above the motor, wherein the plurality of blades curve back inward radially to meet at the central bracket, and wherein the central bracket supports the plurality of blades at their upper ends.

4. The ceiling fan according to claim 3, wherein a majority of the radially inner edge of each of the plurality of fan blades is less than a quarter of an inch from the housing.

5. The ceiling fan according to claim 1, wherein there is a central bracket rotationally connected to the down rod above the motor, wherein the plurality of blades curve back inward radially to meet at the central bracket, and wherein the central bracket supports the plurality of blades at their upper ends.

6. The ceiling fan according to claim 1, wherein the body of each of the fan blades is planar.

7. The ceiling fan according to claim 1, wherein the body of each of the fan blades curves between the upper end and the lower end.

8. The ceiling fan according to claim 1, wherein a majority of the radially inner edge of each of the plurality of fan blades is less than a quarter of an inch from the housing.

9. A ceiling fan suspended by a down rod held by a hanger bracket, comprising:

a. a down rod having a longitudinal axis and comprising at least one member;

b. a motor having a non-moving portion affixed to the down rod, the motor further having a moving portion that rotates at least one of a drive shaft and a plurality of blades around a drive axis of the motor;

c. a housing that encloses at least a portion of the motor; and d. wherein the plurality of blades each comprises an upper end, a lower end, a fan blade body longitudinally extending between the upper end and the lower end, a radially inner edge extending longitudinally, and a radially outer edge, the radially inner edge of each blade having a concave shape to accommodate the housing; and e. wherein the upper end of each of the plurality of fan blades is proximate at least one of the housing, the down rod, and the drive shaft;

f. wherein the lower end of each of the plurality of fan blades is proximate at least one of the housing, the down rod, and the drive shaft; and g. wherein a majority of the radially inner edge of each of the plurality of fan blades is less than an inch from the housing.

10. The ceiling fan according to claim 9, further comprising a collar affixed to the blades driven by the motor to rotate the plurality of fan blades; and wherein at least 90% of the radially inner edge of each of the plurality of fan blades is less than an inch from the housing.

11. The ceiling fan according to claim 10, wherein there is a central bracket rotationally connected to the down rod above the motor, wherein the plurality of blades curve back inward radially to meet at the central bracket, and wherein the central bracket supports the plurality of blades at their upper ends.

12. The ceiling fan according to claim 9, wherein a portion of the housing rotates with the plurality of fan blades and further wherein all of the radially inner edge of each of the plurality of fan blades is less than an inch from the housing.

13. The ceiling fan according to claim 12, wherein there is a central bracket rotationally connected to the down rod above the motor, wherein the plurality of blades curve back inward radially to meet the a central bracket, and wherein the central bracket supports the plurality of blades at their upper ends.

14. The ceiling fan according to claim 13, wherein a majority of the radially inner edge of each of the plurality of fan blades is less than a quarter of an inch from the housing.

15. The ceiling fan according to claim 9, wherein there is a central bracket rotationally connected to the down rod above the motor, wherein the plurality of blades curve back inward radially to meet at the central bracket, and wherein the central bracket supports the plurality of blades at their upper ends.

16. The ceiling fan according to claim 9, wherein each of the fan blades is supported in a central portion and the upper end and lower end is free.

17. The ceiling fan according to claim 9, wherein each of the fan blades is supported in a central portion and the upper end and lower end is free and further wherein and further wherein a majority of the radially inner edge of each of the plurality of fan blades is less than a quarter of an inch from the housing.

18. The ceiling fan according to claim 9, wherein a majority of the radially inner edge of each of the plurality of fan blades is less than a quarter of an inch from the housing.

19. A ceiling fan suspended by a down rod held by a hanger bracket, comprising:

a. a down rod having a longitudinal axis and comprising at least one member;

b. a motor having a non-moving portion affixed to the down rod, the motor further having a moving portion that rotates at least first and second arms around a drive axis of the motor;

c. a housing that encloses at least a portion of the motor, the arms extending radially outward; and d. a fan blade having first and second ends supported by the first and second arms, respectively, the first arm extending outward radially to support a first distal end of the fan blade and the second arm extending outward radially to support a second distal end of the fan blade with the distal ends of the fan blade being supported by distal ends of the first and second arms, the first distal end of the fan blade affixed to the distal end of the first arm, and the second distal end of the fan blade affixed to the distal end of the second arm; and e. the fan blade extending down from the distal end of the first arm, extending under the housing, and extending back up to the distal end of the second arm, the fan blade being unsupported by the housing and unsupported by the motor.

20. The ceiling fan according to claim 19, wherein the fan blade is unsupported by the arms, except at their respective distal ends.

* * * * *